US008109425B2

(12) United States Patent
Liu et al.

(10) Patent No.: US 8,109,425 B2
(45) Date of Patent: Feb. 7, 2012

(54) SHOOTING MODE SWITCH CONTROL MECHANISM FOR NAIL GUN

(75) Inventors: Hsien-Nung Liu, Taipei County (TW); Yu-Chuan Ho, Taipei County (TW)

(73) Assignee: Central Fastener Co., Ltd., Xindian (TW)

( * ) Notice: Subject to any disclaimer, the term of this patent is extended or adjusted under 35 U.S.C. 154(b) by 0 days.

(21) Appl. No.: 12/923,182

(22) Filed: Sep. 8, 2010

(65) Prior Publication Data

US 2011/0248061 A1 Oct. 13, 2011

(51) Int. Cl.
*B25C 1/04* (2006.01)

(52) U.S. Cl. ..... 227/8; 227/130

(58) Field of Classification Search ..... 227/8, 130, 227/142

See application file for complete search history.

(56) References Cited

U.S. PATENT DOCUMENTS 4,629,106 A * 12/1986 Howard et al. ..... 227/8
5,551,621 A * 9/1996 Vallee ..... 227/8
5,791,545 A * 8/1998 Lin ..... 227/8
5,836,501 A * 11/1998 Lai ..... 227/8
6,116,488 A * 9/2000 Lee ..... 227/8
6,213,372 B1 * 4/2001 Chen ..... 227/8
6,419,140 B1 * 7/2002 Chen ..... 227/8
6,422,446 B1 * 7/2002 Liu ..... 227/8
6,588,642 B1 * 7/2003 Wang et al. ..... 227/8
6,659,324 B1 * 12/2003 Liu ..... 227/8
6,857,547 B1 * 2/2005 Lee ..... 227/8
6,860,416 B1 * 3/2005 Chen ..... 227/8
6,953,137 B2 * 10/2005 Nakano et al. ..... 227/8
7,070,080 B2 * 7/2006 Lin ..... 227/8
7,152,773 B2 * 12/2006 Ke ..... 227/8
7,314,154 B2 * 1/2008 Huang et al. ..... 227/8
7,322,426 B2 * 1/2008 Aguirre et al. ..... 173/1
7,464,843 B2 * 12/2008 Huang ..... 227/8
7,810,688 B2 * 10/2010 Wu et al. ..... 227/8
7,971,766 B2 * 7/2011 Tang ..... 227/8

* cited by examiner

*Primary Examiner* — Scott A. Smith
(74) *Attorney, Agent, or Firm* — Bacon & Thomas, PLLC

(57) ABSTRACT

A shooting mode switch control mechanism used in a nail gun is disclosed to include a trigger, a lever function stop member pivotally mounted in the trigger, a spring member stopped against the stop member and a switch pivotally mounted in the trigger. The spring member and the switch are arranged at two sides relative to the pivoted area of the stop member so that when the switch is in the single-shooting position and the trigger is released, the second end portion of the stop member is forced by the spring member into the moving path of the safety bar and pushable by the safety bar for enabling the stop member to activate the air-valve switch once each time the trigger is pressed. When the switch is in the continuous-shooting position, the first end portion of the stop member is stopped against the switch for enabling the second end portion of the stop member to be continuously pushed by the safety bar to activate the air-valve switch continuously. By using the stop member to match with the left-sided switch and the right-sided spring member for controlling the biasing angle of the stop member, one single spring member can provide the necessary power for returning the stop member and the trigger, and therefore the invention has a compact structure characteristic.

8 Claims, 9 Drawing Sheets

SHOOTING MODE SWITCH CONTROL MECHANISM FOR NAIL GUN

BACKGROUND OF THE INVENTION

1. Field of the Invention

The present invention relates to nail guns and more particularly, to a shooting mode switch control mechanism for use in a nail gun.

2. Description of the Related Art

To fit different working requirements, a nail gun is generally equipped with a shooting mode switch control mechanism for allowing switching between a single-shooting mode and a continuous-shooting mode.

When the shooting mode control switch mechanism is switched to the single-shooting mode, the operator must stop the safety bar of the nail gun against the workpiece and then press the trigger to activate an air-valve switch for firing a nail. For firing a next nail, the operator must release the trigger and then press the trigger again. When the shooting mode control switch mechanism is switched to the continuous-shooting mode, the operator must keep the trigger in the pressed position and then continuously strike the safety bar against the workpiece, causing the air-valve switch to be triggered to fire nails continuously.

However, the shooting mode control switch mechanism is normally set adjacent to the trigger to facilitate switching by the operator. However, the design of a shooting mode control switch mechanism in a nail gun must consider the factors of manipulation, linkage and installation position. In consequence, regular shooting mode control switch mechanisms commonly have the drawbacks of large size and complicated structure.

SUMMARY OF THE INVENTION

The present invention has been accomplished under the circumstances in view. It is the main object of the present invention to provide a shooting mode switch control mechanism for use in a nail gun, which has the characteristic of compact structure.

To achieve this and other objects of the present invention, a shooting mode switch control mechanism comprises a trigger, a stop member, a spring member and a switch. The trigger is pivotally mounted in the gun body of a nail gun. The stop member is pivotally mounted in the trigger of the nail gun, having a first end portion and a second end portion disposed at two opposite sides relative to the pivoted area between the stop member and the trigger. The spring member is mounted in the gun body at the side of the second end portion of the stop member. The spring member is stopped against the second end portion of the stop member to impart a spring force to the trigger through the stop member for biasing the trigger in direction away from the air-valve switch. The switch is pivotally mounted in the trigger at the side of the first end portion of the stop member and switchable between a single-shooting position and a continuous-shooting position. When the switch is in the single-shooting position and the trigger is pressed, the second end portion of the stop member is kept beyond the moving path of the safety bar. When the switch is in the single-shooting position and the trigger is released, the second end portion of the stop member is forced by the spring member into the moving path of the safety bar and pushable by the safety bar for enabling the stop member to activate the air-valve switch once each time the trigger is pressed. When the switch is in the continuous-shooting position, the first end portion of the stop member is stopped against the switch for enabling the second end portion of the stop member to be continuously pushed by the safety bar to activate the air-valve switch continuously.

DETAILED DESCRIPTION OF THE INVENTION

Figure 1:
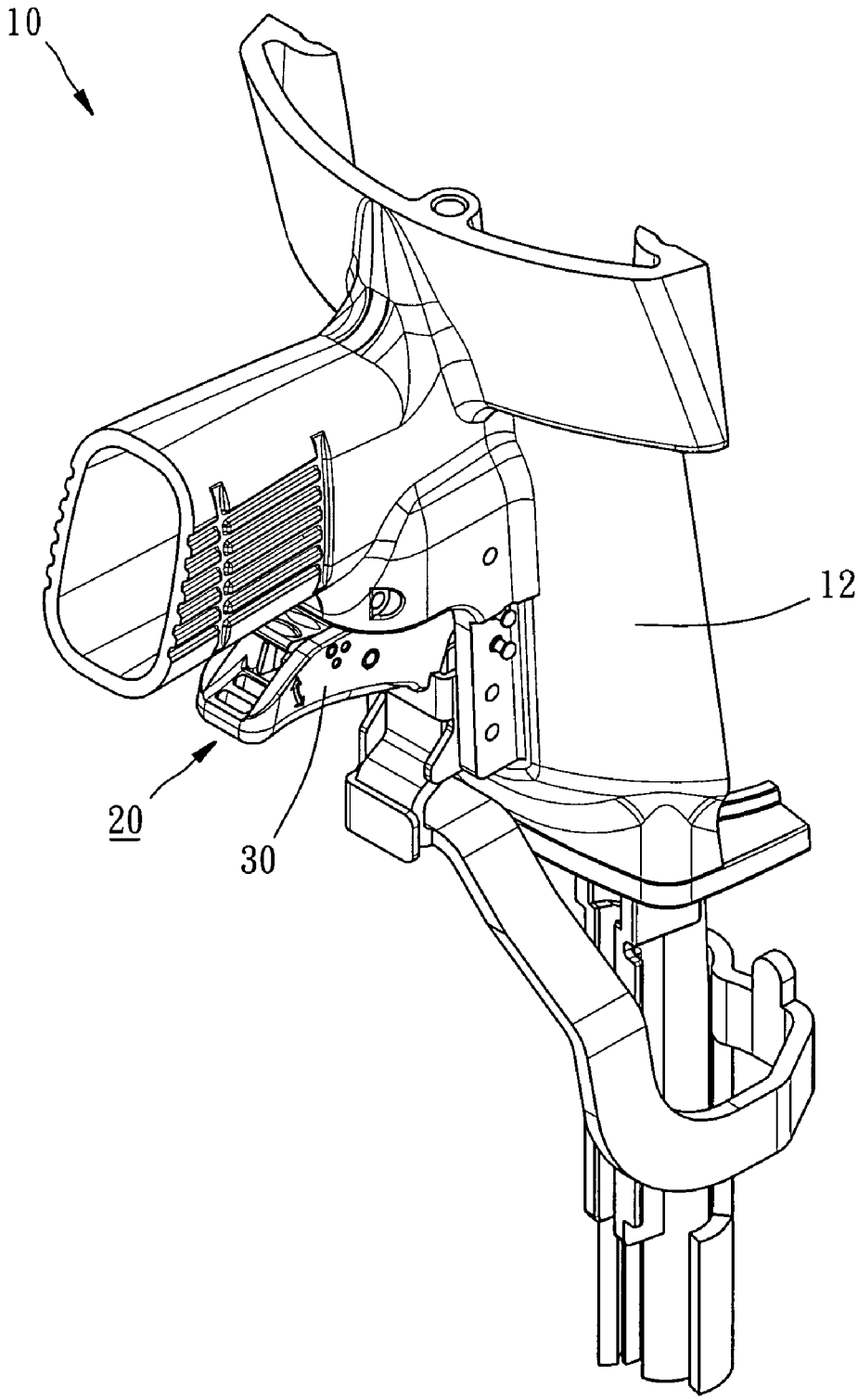
FIG. 1 is an elevational view of a part of a nail gun, illustrating a shooting mode control switch mechanism installed in the gun body in accordance with the present invention.
Figure 2:
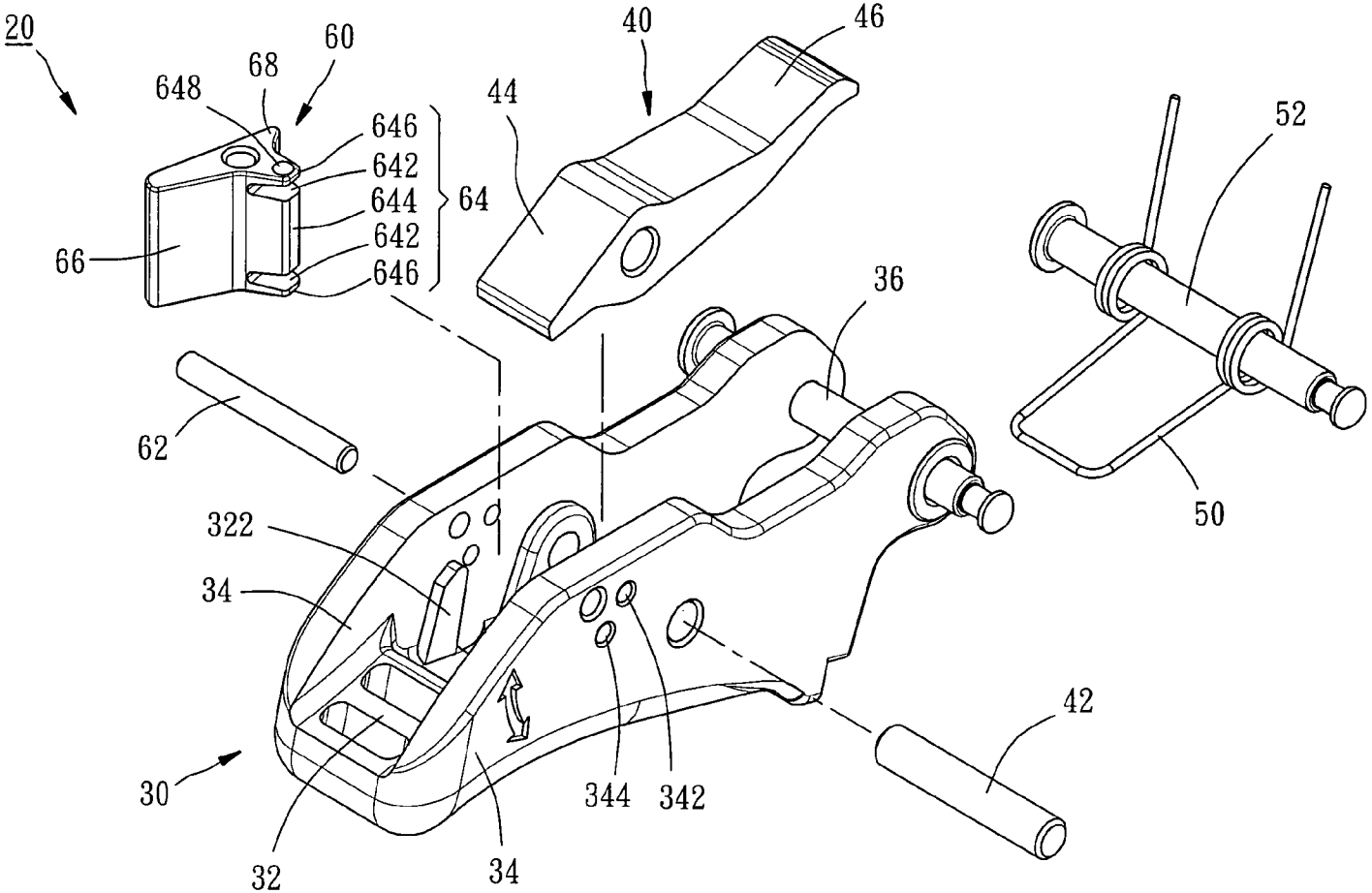
FIG. 2 is an exploded view of the shooting mode control switch mechanism in accordance with the present invention.
Figure 3:
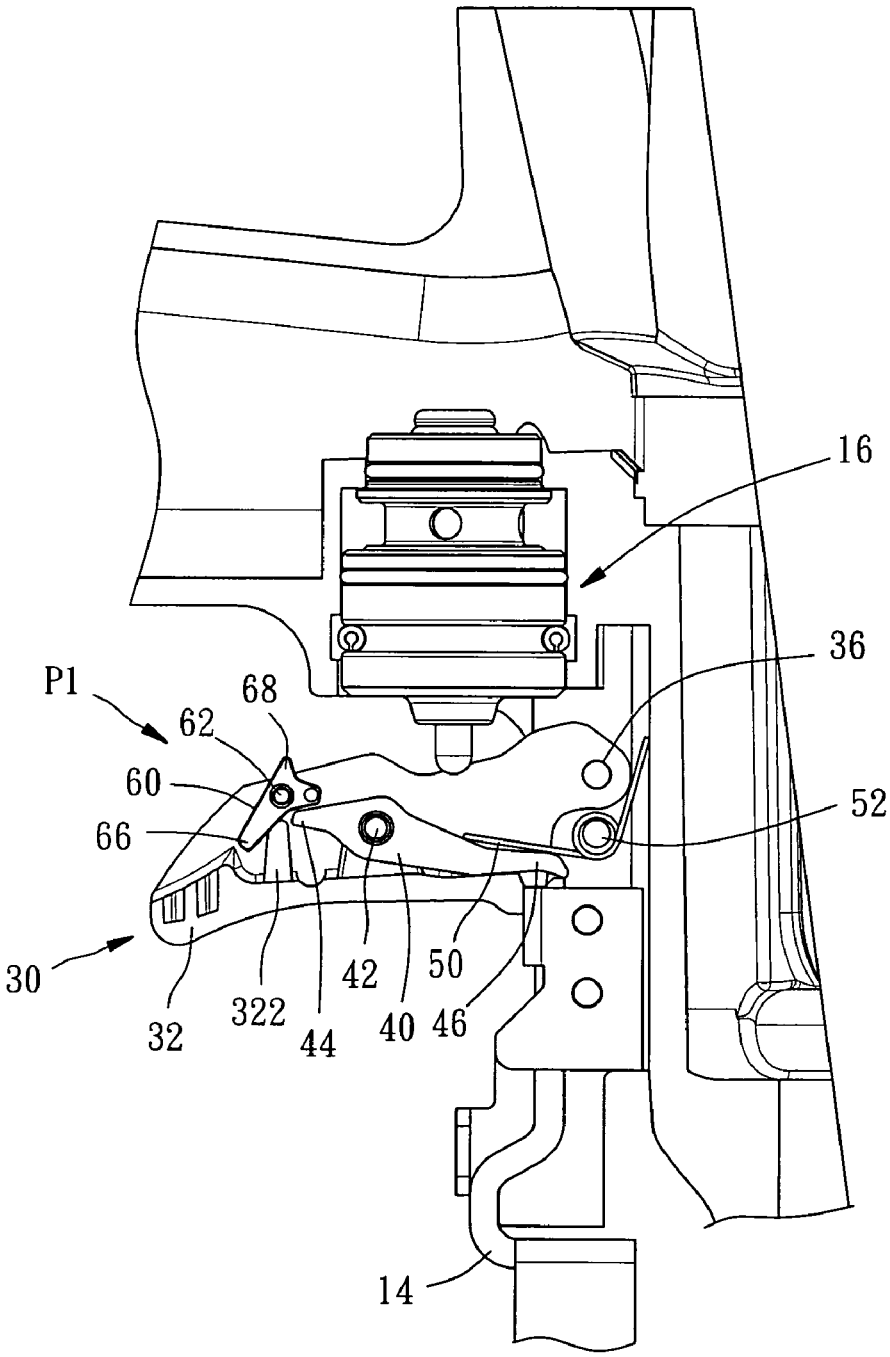
FIG. 3 is a sectional view of the present invention, illustrating the switch in the single-shooting position and the safety bar kept away from the workpiece.

Referring to FIGS. 1~3, a shooting mode switch control mechanism 20 used in a nail gun 10 in accordance with the present invention is shown comprising a trigger 30, a stop member 40, a spring member 50 and a switch 60.

The trigger 30 has a bottom wall 32, two opposing sidewalls 34, and two stop flanges 322 respectively protruded from the sidewalls 34. A pivot pin 36 is inserted through the two sidewalls 34 to pivotally connect the trigger 30 to the gun body 12 of the nail gun 10. Further, each sidewall 34 has a first hole 342 and a second hole 344.

The stop member 40 is pivotally connected between the two sidewalls 34 of the trigger 30 by a pivot pin 42, i.e., the stop member 40 has a first end portion 44 disposed at the left side relative to the pivot pin 42 and a second end portion 46 disposed at the right side relative to the pivot pin 42.

The spring member 50 is a torsional spring wound round an axle 52 in the gun body 12 and secured thereto. The spring member 50 is disposed at the right side relative to the stop member 40, having the two distal ends thereof respectively stopped against the gun body 12 and the middle part thereof stopped against the second end portion 46 of the stop member 40 to impart a spring force to the stop member 40, causing the stop member 40 to bias the trigger 30 in direction toward an air-valve switch 16 far from the nail gun 10, i.e., the stop member 40 and the trigger 30 use the common spring member 30 to achieve a pivot function.

Figure 7:
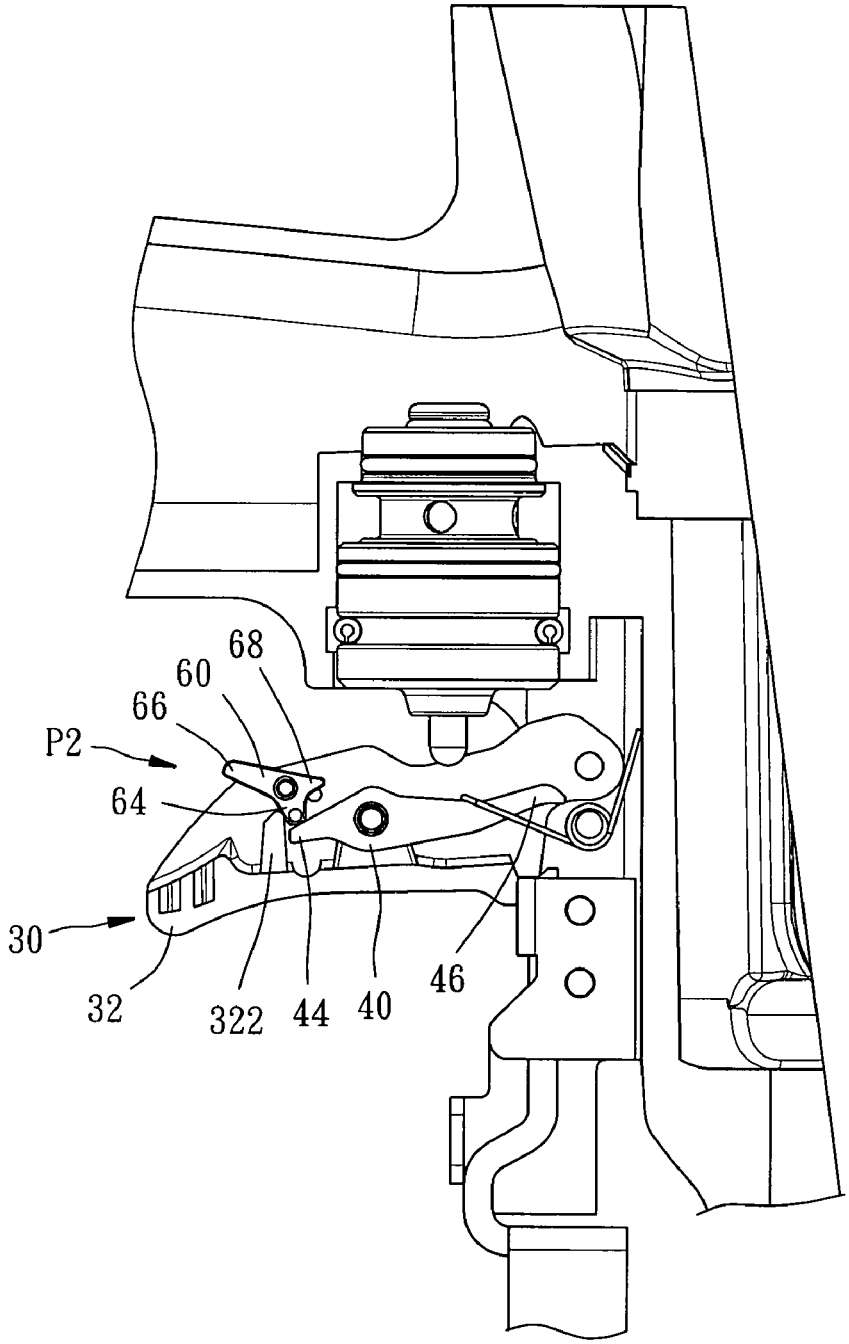
FIG. 7 is similar to FIG. 3, illustrating the status after the switch moved to the continuous-shooting position.

The switch 60 is pivotally connected between the two sidewalls 34 of the trigger 30 by a pivot pin 62 and disposed at the left side relative to the stop member 40, having a retaining portion 64, a first lever 66 and a second lever 68 radially extended from its center of rotation. The retaining portion 64 has two notches 642 and is divided by the two notches 642 into one first block 644 and two second blocks 646. Subject to the design of the notches 642, each second block 646 is elastically deformable when compressed. Further, each second block 646 has a raised spot 648 located from the end face thereof. By means of deforming the second blocks 646, the raised spots 648 can be selectively engaged into the respective first holes 342 or second holes 344 of the trigger 30. When the raised spots 648 are engaged into the first holes 342 of the trigger 340, the switch 60 is kept in a single-shooting position P1, as shown in FIG. 3, where one side of the first lever 66 of the switch 60 is stopped against the stop flanges 322 of the trigger 30, assuring positive engagement between the raised spots 648 and the first holes 342. At this time, the second end portion 46 of the stop member 40 is stopped at the bottom wall 32 of the trigger 30 and the first end portion 44 of the stop member 40 is spaced from the switch 60 by a gap, avoiding accidental triggering of the switch 60. In another word, the stop design of the said stop flanges 322 or the said bottom wall 32 prohibits the switch 60 from being forced by the first end portion 44 of the stop member 40 to switch the position accidentally. When the raised spots 648 are engaged into the second holes 344 of the trigger 340, the switch 60 is kept in a continuous-shooting position P2, as shown in FIG. 7, where one side of the retaining portion 64 of the switch 60 is stopped against the stop flanges 322 of the trigger 30, assuring positive engagement between the raised spots 648 and the second holes 344. At this time, the first end portion 44 of the stop member 40 is stopped against the switch 60, and the action force thus produced from stopping the first end portion 44 against the switch 60 goes through the center of rotation of the switch 60, prohibiting the switch 60 from being forced by the first end portion 44 of the stop member 40 to switch the position accidentally. At this time, the second end portion 46 of the stop member 40 is spaced from the bottom wall 32 of the trigger 30 by a gap. Further, the first lever 66 extends out of the trigger 30 when the switch 60 is kept in the continuous-shooting position P2, allowing operation by an external force to switch the switch 60 from the continuous-shooting position P2 to the single-shooting position P1. The second lever 68 extends out of the trigger 30 when the switch 60 is kept in the single-shooting position P1, allowing operation by an external force to switch the switch 60 from the single-shooting position P1 to the continuous-shooting position P2.

After understanding of the structural details of the shooting mode switch control mechanism 20, the operation and features of the invention are outlined hereinafter.

Figure 4:
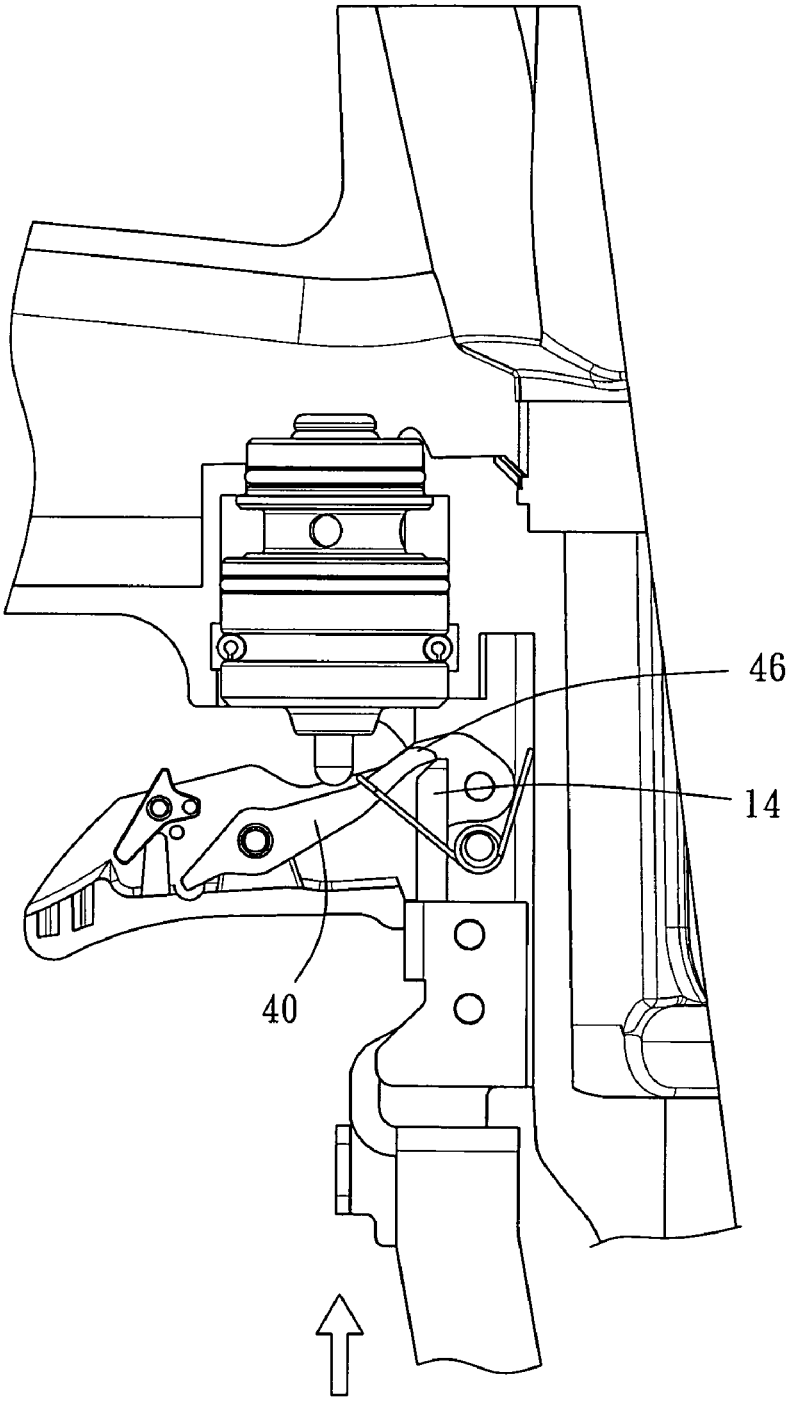
FIG. 4 is similar to FIG. 3, illustrating the stop member pushed by the safety bar.
Figure 5:
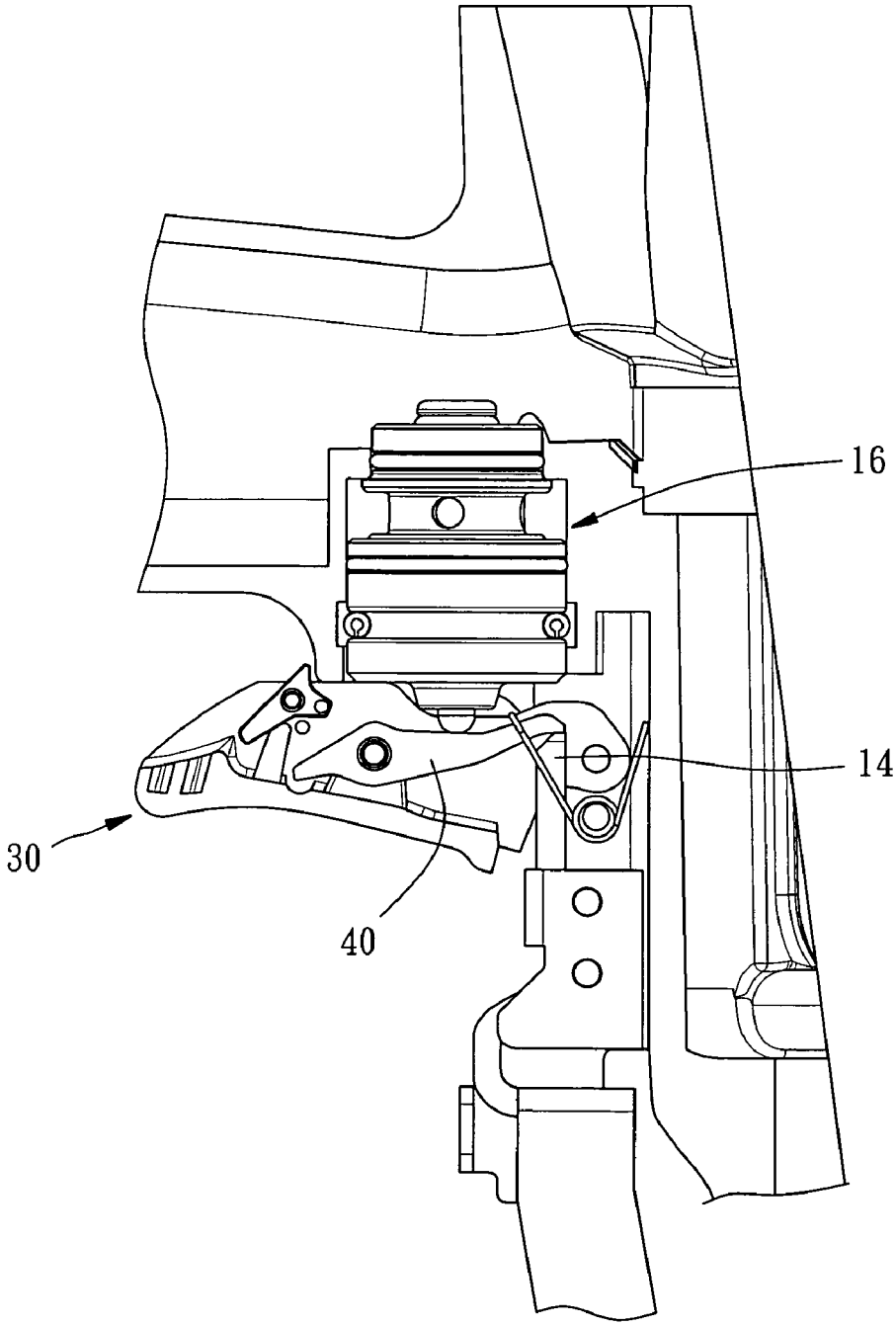
FIG. 5 is similar to FIG. 4, illustrating the status after press of the trigger.
Figure 6:
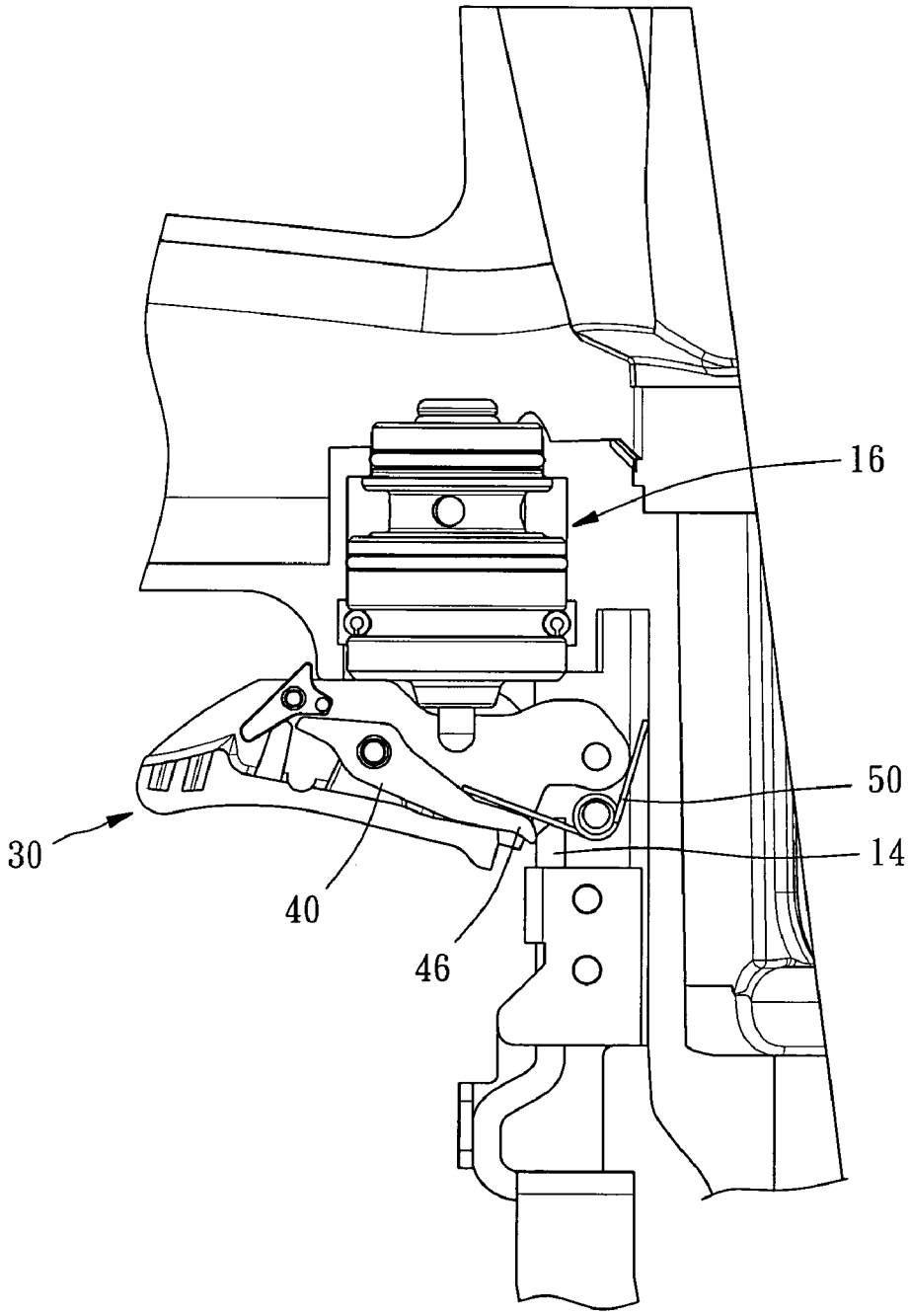
FIG. 6 is similar to FIG. 5, illustrating the status after release of the trigger.

When the operator wishes to drive nails into the workpiece by means of the single-shooting mode, operate the first lever 66 of the switch 60 to switch the switch to the single-shooting position P1, as shown in FIG. 3, and then stop the safety bar 14 of the nail gun 10 against the workpiece, causing the safety bar 14 to be moved upwards. Thereafter, push the second end portion 46 of the stop member 40 during upward movement of the safety bar 14, as shown in FIG. 4, and then operate the trigger 30 to force the stop member 40 against the air-valve switch 16, firing a nail, as shown in FIG. 5. Upon finish of one shooting action, the gun body 12 is lifted due to the impact of the nail against the workpiece, and the safety bar 14 is moved away from the workpiece to the initial position. At this time, the push force is released from the second end portion 46 of the stop member 40, and the stop member 40 is returned to its former position by the spring member 50. Under this condition, even if the operator presses the trigger 30 and stops the safety bar 14 against another location of the workpiece, the second end portion 46 of the stop member 40 will not be pushed by the safety bar 14, as shown in FIG. 6, and the air-valve switch 16 will not be activated by the stop member 40, avoiding accidental triggering. In another word, the operator must remove the safety bar 14 from the workpiece and release the trigger 30 and then repeat the aforesaid procedure for allowing firing of a nail again.

Figure 8:
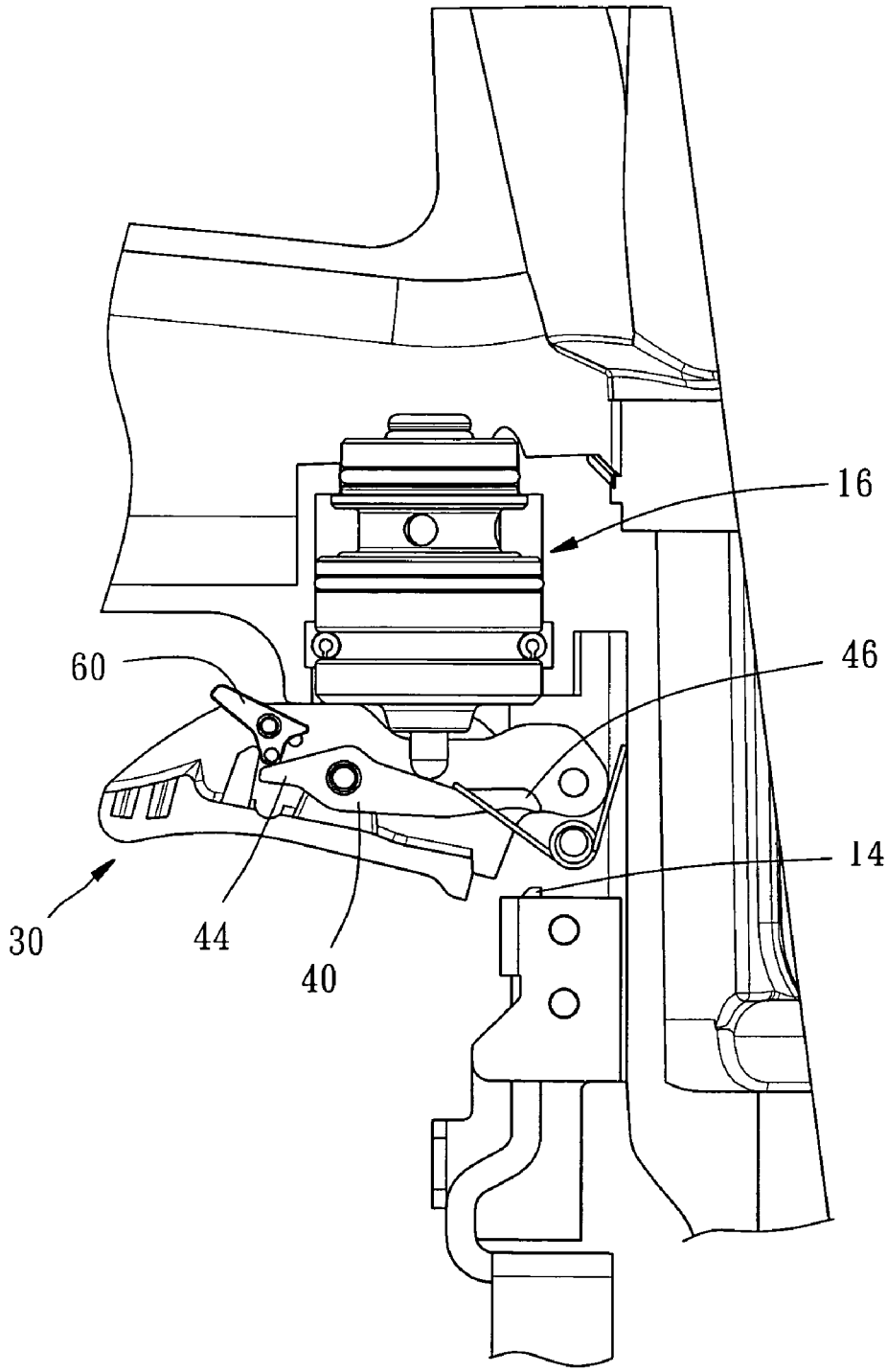
FIG. 8 is similar to FIG. 7, illustrating the trigger held in the pressed position before movement of the second end portion of the stop member by the safety bar.
Figure 9:
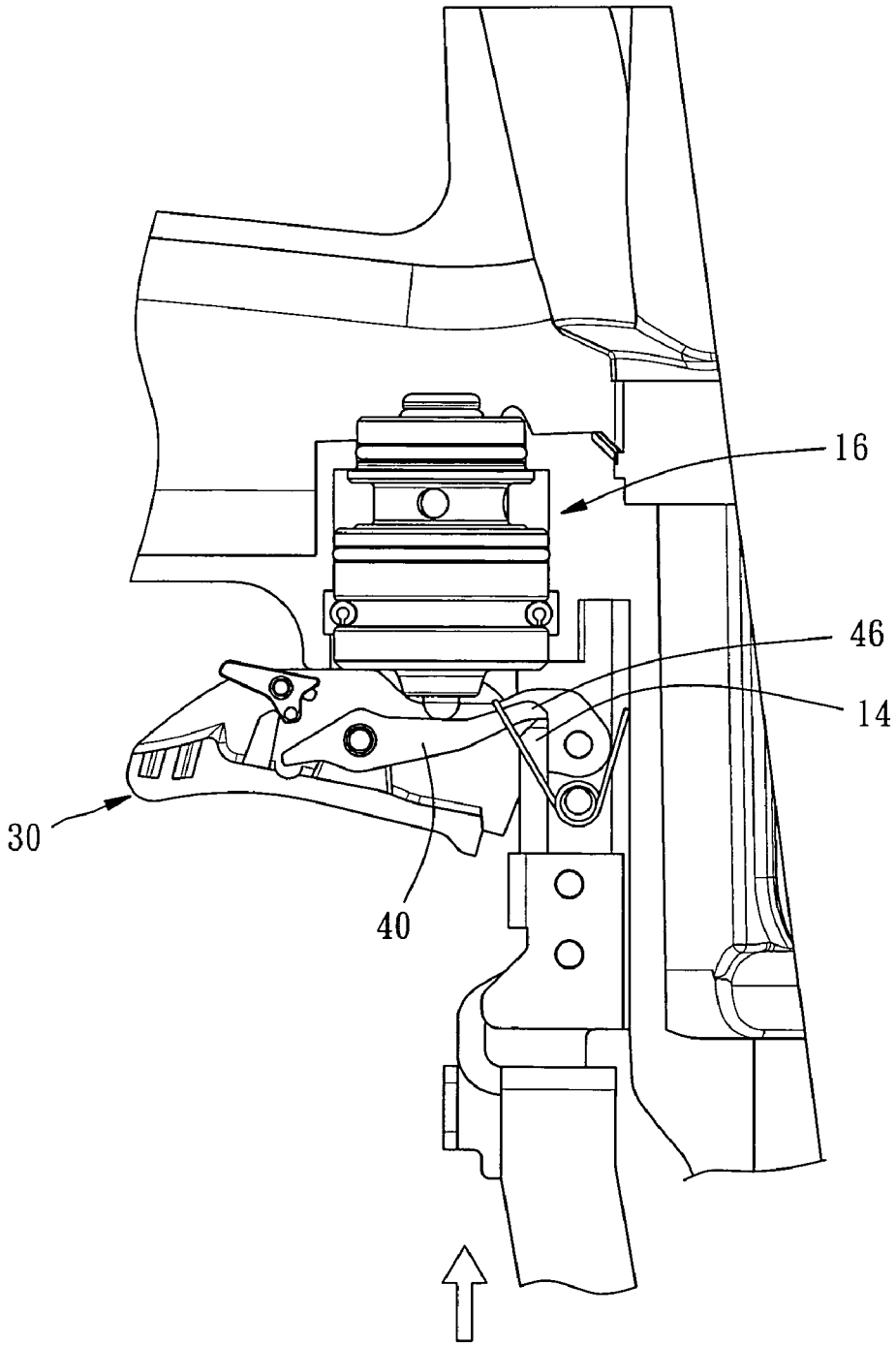
FIG. 9 is similar to FIG. 8, illustrating the second end portion of the stop member pushed by the safety bar.

On the other hand, when the user swishes to drive nails into the workpiece by means of the continuous-shooting mode, operate the second lever 68 of the switch 60 to switch the switch to the continuous-shooting position P2, as shown in FIG. 8. At this time, the first end portion 44 of the stop member 40 is stopped by the switch 60, the biasing angle of the stop member 40 is limited, and the second end portion 46 of the stop member 40 is kept in the moving path of the safety bar 14. Thereafter, the operator can continuously strike the safety bar 14 against the workpiece at other locations. Each time the operator strikes the safety bar 14 against the workpiece, the second end portion 46 of the stop member 40 is pushed by the safety bar 14 once, and therefore the stop member 40 can activate the air-valve switch 16 continuously to achieve continuous shooting of nails, as shown in FIG. 9.

In conclusion, the shooting mode switch control mechanism of the invention uses a lever function stop member to match with the position change of a switch at the left side relative to the stop member for controlling the biasing angle of the stop member to achieve switching between a single-shooting mode and a continuous-shooting mode. The use of one single spring member at the right side relative to the stop member is sufficient to provide the necessary return force for returning the stop member and the trigger. Therefore, the invention has the characteristics of compact structure and accurate action.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A shooting mode switch control mechanism installed in a gun body of a nail gun and pushable by a safety bar to activate an air-valve switch for firing nails, comprising:

a trigger pivotally mounted in said gun body;

a stop member pivotally mounted in said trigger, said stop member having a first end portion and a second end portion disposed at two opposite sides relative to the pivoted area between said stop member and said trigger;

a spring member mounted in said gun body at the side of the second end portion of said stop member, said spring member being stopped against the second end portion of said stop member to impart a spring force to said trigger through said stop member for biasing said trigger in direction away from said air-valve switch; and a switch pivotally mounted in said trigger at the side of the first end portion of said stop member and switchable between a single-shooting position and a continuous-shooting position;

wherein when said switch is in said single-shooting position and said trigger is pressed, the second end portion of said stop member is kept beyond the moving path of said safety bar; when said switch is in said single-shooting position and said trigger is released, the second end portion of said stop member is forced by said spring member into the moving path of said safety bar and pushable by said safety bar for enabling said stop member to activate said air-valve switch once each time said trigger is pressed; when said switch is in said continuous-shooting position, the first end portion of said stop member is stopped against said switch for enabling the second end portion of said stop member to be continuously pushed by said safety bar to activate said air-valve switch continuously.

2. The shooting mode switch control mechanism as claimed in claim 1, wherein said trigger comprises a first hole and a second hole; said switch comprises a raised spot, said raised spot being engaged into said first hole of said trigger when said switch is in said single-shooting position, said raised spot being engaged into said second hole of said trigger when said switch is in said continuous-shooting position.

3. The shooting mode switch control mechanism as claimed in claim 2, wherein said switch comprises a retaining portion, a first lever and a second lever radially extended from the center of rotation thereof, said retaining portion carrying said raised portion on an end face thereof, said second lever being protruded outside said trigger for operation by an external force to switch said switch from said single-shooting position to said continuous-shooting position when said switch is in said single-shooting position, said first lever being protruded outside said trigger for operation by an external force to switch said switch from said continuous-shooting position to said single-shooting position when said switch is in said continuous-shooting position.

4. The shooting mode switch control mechanism as claimed in claim 3, wherein said retaining portion of said switch comprises a notch and is divided by said notch into a first block and a second block, said second block carrying said raised spot and being elastically deformable by an external force through said notch.

5. The shooting mode switch control mechanism as claimed in claim 3, wherein said trigger comprises at least one stop flange for stopping one side of said first lever when said switch is in said single-shooting position and for stopping one side of said retaining portion of said switch when said switch is in said continuous-shooting position.

6. The shooting mode switch control mechanism as claimed in claim 1, wherein said spring member is a torsional spring wound round a pivot axle in said gun body, having two distal ends thereof stopped against said gun body and a middle part thereof stopped against said second end portion of said stop member.

7. The shooting mode switch control mechanism as claimed in claim 1, wherein said first end portion of said stop member is stopped against said switch to impart an action force through the center of rotation of said switch when said switch is in said continuous-shooting position.

8. The shooting mode switch control mechanism as claimed in claim 1, wherein said second end portion of said stop member is forced by said spring member to stop against said trigger and said first end portion of said stop member is kept away from said switch when said switch is in said single-shooting position.

* * * * *